United States Patent [19]

Casper et al.

[11] 4,445,463

[45] May 1, 1984

[54] WASTE HEAT BOILER

[75] Inventors: James R. Casper; Harvey J. Hauer, both of Wilmington, Del.

[73] Assignee: Syngas Company, Deer Park, Tex.

[21] Appl. No.: 482,595

[22] Filed: Apr. 6, 1983

[51] Int. Cl.[3] ..... F22B 1/18; F22B 37/24

[52] U.S. Cl. ..... 122/7 R; 122/510

[58] Field of Search ..... 122/7 R, 78, 32, 510

[56] References Cited

U.S. PATENT DOCUMENTS

| | | | |
|---|---|---|---|
| 1,826,358 | 10/1931 | Marriott | 122/7 R |
| 1,834,001 | 12/1931 | Modine . | |
| 1,868,661 | 7/1932 | Heimberger . | |
| 2,239,895 | 4/1941 | Kuhner | 122/7 R |
| 2,654,657 | 10/1953 | Reed | 23/277 |
| 2,879,977 | 3/1959 | Trought | 257/263 |
| 3,607,645 | 9/1971 | Stankiewicz | 176/87 |
| 3,814,063 | 6/1974 | Bijmholt | 122/510 |
| 3,929,189 | 12/1975 | Lecon | 122/510 |
| 4,029,054 | 6/1977 | Schaurman | 122/7 R |
| 4,094,813 | 6/1978 | Van Lookeren | 122/7 R |
| 4,286,549 | 9/1981 | Eisinger | 122/510 |

*Primary Examiner*—Henry C. Yuen

[57] ABSTRACT

Some waste heat boilers require more internal support than conventional to protect the tubes, particularly during start-up. This support can be provided by a support rod attached to the top of the boiler shell and at the other end to the entrance tubes. The rod has a lower coefficient of thermal expansion than the material used for the boiler shell. The differential expansion of the rod and the shell provides the additional support for the tubes.

3 Claims, 2 Drawing Figures

WASTE HEAT BOILER

DESCRIPTION

BACKGROUND OF THE ART

In processes involving the partial oxidation of hydrocarbons to produce synthesis gas, the gas stream from the partial oxidation reactor is often at temperatures of 1200°-1500° C. This hot gas stream is therefore a source of energy as well as process gas. In many instances, this energy is recovered by having the hot gas stream flow through tubes in a waste heat boiler wherein the heat is transferred to water and steam generated.

When the gas stream first enters the tubes in the boiler, it is very hot, and in view of its acceleration upon entering the tubes, very turbulent. This turbulence causes very high rates of heat transfer at the entrance to the tubes. This in turn can cause melting and, coupled with the corrosive materials in the gas stream, corrosion of the tubes is accelerated.

To alleviate this problem it has been proposed to use tubes having a flared entrance. However, these tubes usually are designed to have cooling water recirculated under pressure within the tube walls to cool the ends. The axial component of the hydraulic forces of the pressurized recirculating water in the flared tubes creates an axial loading that requires internal support in addition to that usually provided for the tubes. This support is particularly needed during start-up when the water side of the boiler is brought up to temperature and pressure before the oxidation reactor is fired to generate gas pressure. Without this additional internal support, the tubes can be overloaded and fail.

SUMMARY OF THE INVENTION

The invention is a support rod that is installed with the boiler shell. At one end the rod is attached to the top of the shell, at its other end it is attached to the entrance tubes. The rod, or at least part of it, is made of a material having a lower coefficient of thermal expansion than the material used for the boiler shell.

As the boiler is heated, the difference in thermal expansion between the shell and the support rod develops tension in the structure to provide the necessary tube support.

DESCRIPTION OF THE INVENTION

Figure 1:
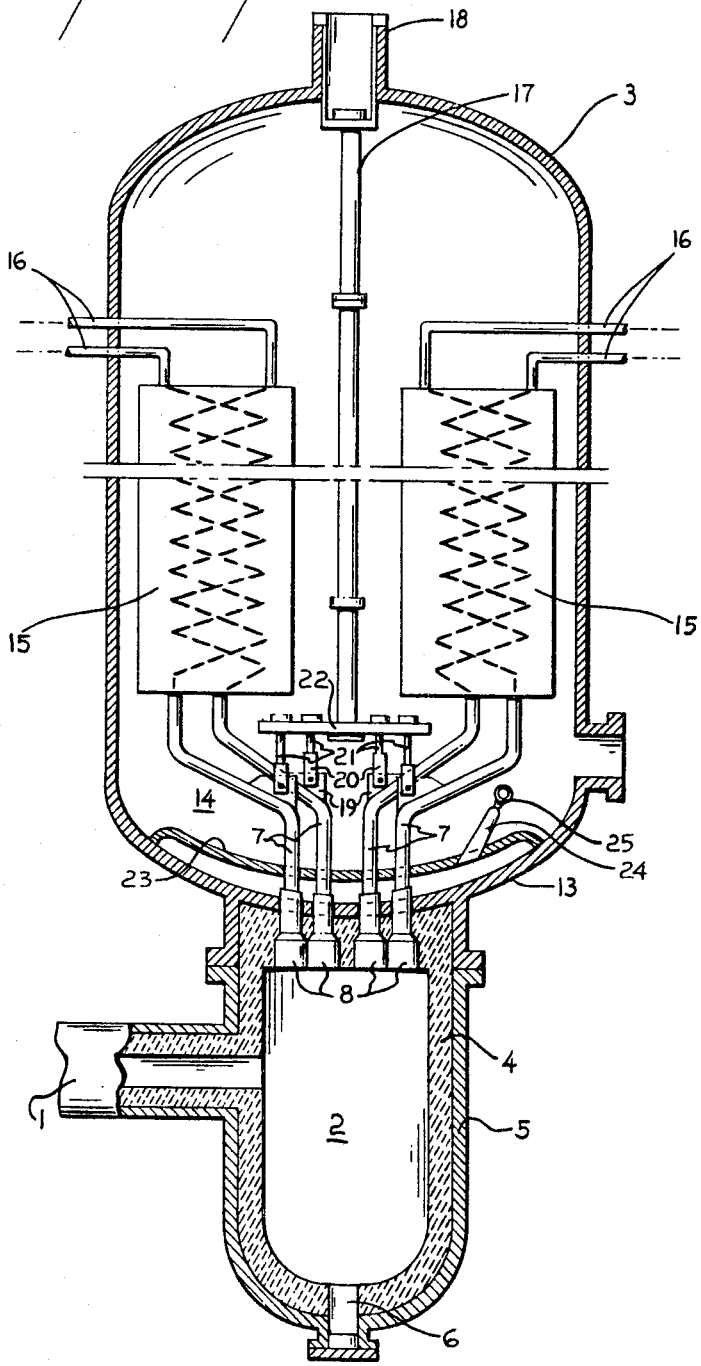
FIG. 1 is a cut-away sectional elevation of a waste heat boiler illustrating the support rod of the invention.

With reference to FIG. 1, hot process gas from a partial oxidation reactor (not illustrated) or the like is fed through a gas transfer line 1 into the bottom chamber 2 of a waste heat boiler 3. This chamber is usually a refractory lined 4 metal vessel 5. At the bottom of the chamber 2 it is conventional to provide means 6 for collecting particulates, e.g., ash, and discharging them.

Figure 2:
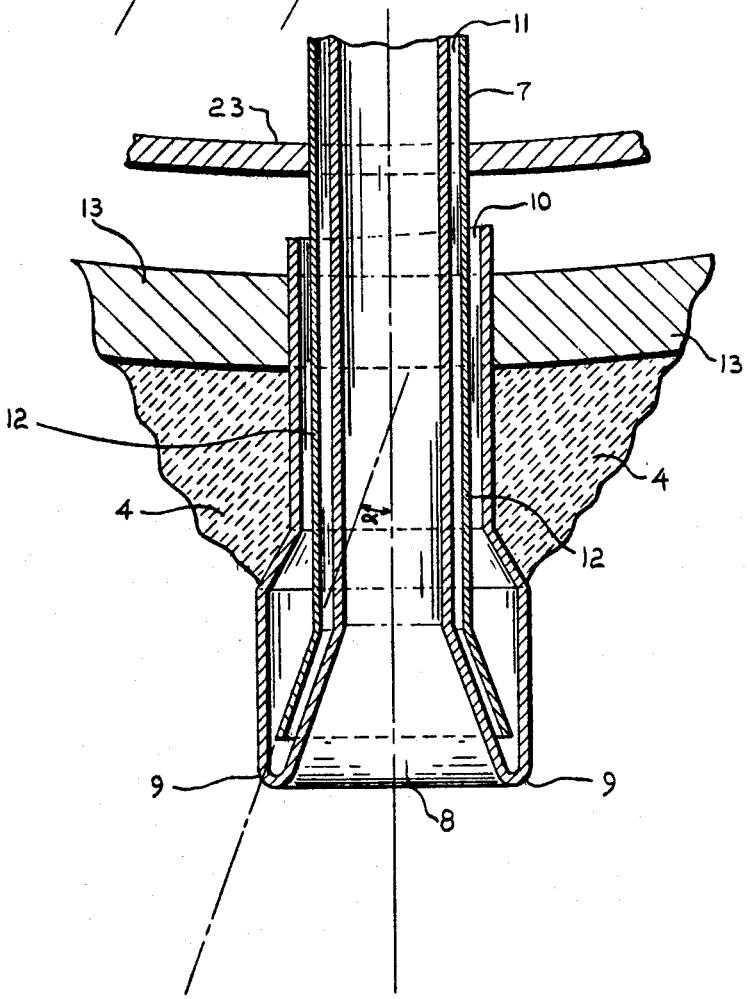
FIG. 2 is a detail of the flared opening at the bottom end of an entrance tube.

At the top of chamber 2 are located the entrance tubes 7 of the waste heat boiler. The hot gases flow through the openings 8 of the entrance tubes 7 into the boiler interior. As illustrated in FIG. 2, the openings can be flared. By flared is meant that the end of the tube is at an angle ($\alpha$) of up to 5°-7° from the vertical. As previously mentioned, it is preferred to use flared openings to alleviate tube failures due to high gas velocities and high heat flux.

It is often desirable to coat the end of the tube with an alloy to protect the inlet area from corrosion, particularly when the gases involved are at high temperatures and contain hydrogen sulfide, soot and particulate matter which can cause corrosion or erosion. A useful alloy containing about 41 weight % chromium and 6 weight % aluminum can be applied by diffusion coating processes.

In the illustrated embodiment the tube walls 9 are hollow and divided into two separate sections 10 and 11 by a thin baffle 12. Cooling water is circulated under pressure down through section 10 and up through 11 to cool the end of the tubes.

The means for circulating the cooling water include a water circulating pump (not illustrated) outside of the boiler that recirculates water under pressure through suitable conduits to a nozzle 25. The nozzle is connected to an inducer jet 24 which is mounted on plate 23. Plate 23 and the shell 13 form a pressurized plenum. Section 10 of the tube is open to the plenum and section 11 communicates with the main section of the boiler above plate 23.

In operation, water is drawn from the main section of the boiler and combined with water from the nozzle 25 and together they are discharged as a jet into the inducer 24. This action induces additional water to flow into the plenum and provides a slight increase in pressure in the plenum. The pressure causes the water to flow down section 10 and up section 11 back to the main section of the boiler.

The entrance tubes 7 extend through the metal shell 13 of the waste heat boiler into the shell interior 14. Within the interior, each entrance tube is connected to a tube coil 15 and the design of the tube coil is not critical. Any conventional design can be employed for the exchange of heat between the hot gases and circulating water. After contact with the water the gases exit 16 the waste heat boiler into annular header rings (not illustrated) for further processing.

Within the interior of the shell is a support rod 17. Although only one is illustrated, in some embodiments it may be desirable to have a plurality of such rods. At its top end the rod is attached to the top 18 of the shell by any suitable means. The bottom of the rod is attached to the entrance tubes 8 by any suitable means. In the embodiment illustrated, the entrance tubes have a flange 19 to which a clevis 20 on a rod 21 is attached. The rod is bolted to a lower support 22 to which the support rod 17 is bolted. Many other methods of attaching the entrance tubes to the support rod will be apparent to those skilled in the art.

The rod can be in one piece or as illustrated, made of several different pieces flanged together. The important feature is that at least part of this rod is made of a material having a lower coefficient of thermal expansion than the metal of the shell 13. For example, if the shell is carbon steel, part of the rod can be made of Ebrite® Alloy (a ferritic stainless steel containing approximately 26% chromium and 1% nickel, ASTM 479 XM-27, manufactured by Allegheny Ludlum Steel Corp.) which has a significantly lower coefficient of thermal expansion than carbon steel. The length of the portion of the rod having the lower coefficient of thermal expansion is determined on the basis of water side pressure, tube side pressure and tube wall temperature to provide the correct amount of differential expansion.

In operation, as the waste heat boiler (water side) is heated, the difference in thermal expansion between the shell and the support rod develops the tension in the structure to provide the necessary tube support. This design has the further advantage in that the rod need not be preloaded to tight tolerances.

We claim:

1. In a vertical waste heat boiler having a vertical shell, extending through the bottom of the shell into the shell interior a plurality of entrance tubes, the entrance tubes connected to tubular means within the shell for heat exchange, the improvement comprising the entrance tubes having flared openings at their bottom end and a vertical support rod extended within the shell, the rod being attached at one end to the top of the shell and at the other end to the entrance tubes, at least part of the support rod being made of a material having a lower coefficient of thermal expansion than the material used for the boiler shell.

2. The boiler of claim 1 wherein the support rod is made of different materials, part of which have a lower coefficient of thermal expansion than the material used for the shell and the rest of the rod.

3. The boiler of claim 1 wherein the entrance tubes have means for recirculating water under pressure to cool their bottom end.

* * * * *